United States Patent [19]

Hogshead, III

[11] 4,128,167

[45] Dec. 5, 1978

[54] SHIPPING AND DISPLAY CARTON FOR PLANTS AND THE LIKE

[76] Inventor: Rodney C. Hogshead, III, P.O. Box 366, Plymouth, Fla. 32768

[21] Appl. No.: 869,669

[22] Filed: Jan. 16, 1978

[51] Int. Cl.[2] ..... B65D 5/22; B65D 5/52

[52] U.S. Cl. ..... 206/44 R; 206/45.19; 229/36

[58] Field of Search ..... 206/44, 45.14; 248/174; 229/36

[56] References Cited

U.S. PATENT DOCUMENTS

| | | | |
|---|---|---|---|
| 2,178,091 | 10/1939 | Weiss | 206/44 R |
| 2,224,938 | 12/1940 | Steckler | 206/44 R X |
| 2,298,136 | 10/1942 | Lavene | 206/44 R |
| 2,793,802 | 5/1957 | Scaturro | 206/44 R UX |
| 2,812,852 | 11/1957 | Samuels | 206/44 R |
| 2,970,685 | 2/1961 | Mayer | 206/44 R |
| 3,164,350 | 1/1965 | Taub | 206/44 R X |
| 3,768,639 | 10/1973 | Dogliotti | 206/45.19 |

*Primary Examiner*—Davis T. Moorhead

*Attorney, Agent, or Firm*—Duckworth, Hobby, Allen & Pettis

[57] ABSTRACT

A shipping and display carton for plants and similar articles includes bottom, back and opposing side walls, the side walls sloping from the top of the back wall toward the bottom wall. The container further includes a top wall joined to the back wall on one edge, the top wall having an inner face toward the bottom wall when the container is in a shipping condition, the top wall further including an outer face with a printed message thereon. The top wall also has first and second side flaps along opposing edges thereof, which edges are normal to the one edge of the top wall. The side flaps extend parallel to and in abutment with a corresponding one of the first and second side walls when the carton is in the shipping position. The carton further includes a weakened line extending across the top wall and dividing the top wall into two portions, such that the top wall may be folded into a display position substantially parallel with the back wall.

15 Claims, 3 Drawing Figures

SHIPPING AND DISPLAY CARTON FOR PLANTS AND THE LIKE

BACKGROUND OF THE INVENTION

1. Field of the Invention

The present invention relates to shipping and display cartons, and in particular, to such cartons which are specifically adapted for shipping and displaying plants and the like.

2. Description of the Prior Art

There are numerous suggestions in the prior art for shipping containers which are specifically adapted to be modified at the container's destination, in order to allow the contents of the container to be displayed for sales purposes.

Dogliotti, in U.S. Pat. No. 3,768,639 discloses a display container which is adapted to permit a message contained on the outer face of the container to be placed in an upright position by folding the top wall of the container along a weakened line of the top wall, such that the forward flap of the top wall and a portion of the top wall itself are parallel with the back wall of the container. In the arrangement disclosed by Dogliotti, the forward flap of the top wall is inserted behind a rigid tray within the void defined by the container in order to rigidly hold the upright, folded top wall in place. Dogliotti also suggests sloping side walls and a small forward wall of the container, in order to allow greater viewing of the contents when the container is folded in the display position.

A similar arrangement is disclosed in U.S. Pat. No. 2,964,169 issues to Brachman. Martin, in U.S. Pat. No. 2,029,659, and Lavere in U.S. Pat. No. 2,298,136, both disclose combination shipping and display cartons of interest.

In U.S. Pat. No. 3,924,354, Gregoire discloses a shipping and display carton for plants, in which the upper portion of the container is removed and thereafter serves as a base for display purposes.

A somewhat similar arrangement is disclosed in U.S. Pat. No. 3,660,934 to Pollack, et al.

Prior art arrangements such as those described above have several disadvantages. First, when the object is being shipped and displayed constitutes relatively heavy materials, such as filled flower pots, the structure of the containers have proven to be insubstantial. Further, containers of the type described above which employ only a single thickness of cardboard or similar material between the goods being shipped and the outside wall have failed to adequately prevent damage to the articles within the container.

SUMMARY OF THE INVENTION

The present invention contemplates a shipping and display carton comprising a bottom wall and a back wall joined to the bottom wall and substantially normal thereto. The carton further includes opposing first and second side walls, each joined substantially normal to the bottom and back wall. A top wall is included and joined along one edge to the back wall, the top wall having an inner face toward said bottom wall when said top wall is parallel thereto and an outer face with a printed message thereon opposing the inner face. The top wall further includes first and second side flaps along opposing edges thereof, which opposing edges are normal to the one edge of the top wall. The side flaps extend parallel to and in abutment with the corresponding one of the first and second side walls when the top wall is in a shipping position parallel with the bottom wall.

The container further includes means permitting bending of the top wall along a line substantially parallel with one edge thereof, such that the outer face of the top wall may be bent into two portions and folded into a display position substantially parallel with the back wall such that the message faces outward across the container. Means are further provided within the void defined by the walls for holding the bent top wall in the display position.

An important aspect of the present invention is the utilization of a folded container, preferably formed of cardboard or similar material, in which the side and front walls have a spaced double thickness so as to prevent undue damage to the goods within the container.

Another aspect of the present invention is the utilization of perforated lines between the side flaps of the top wall and the main body of the top wall, in order to facilitate removal of the side flaps when the container is being folded into a display position. This permits the side flaps to be utilized to prevent damage to the goods within the container during shipping, but allowing the side flaps to be removed for a more compact display of the goods contained therein.

THE DRAWINGS

DESCRIPTION OF THE PREFERRED EMBODIMENT

Figure 1:
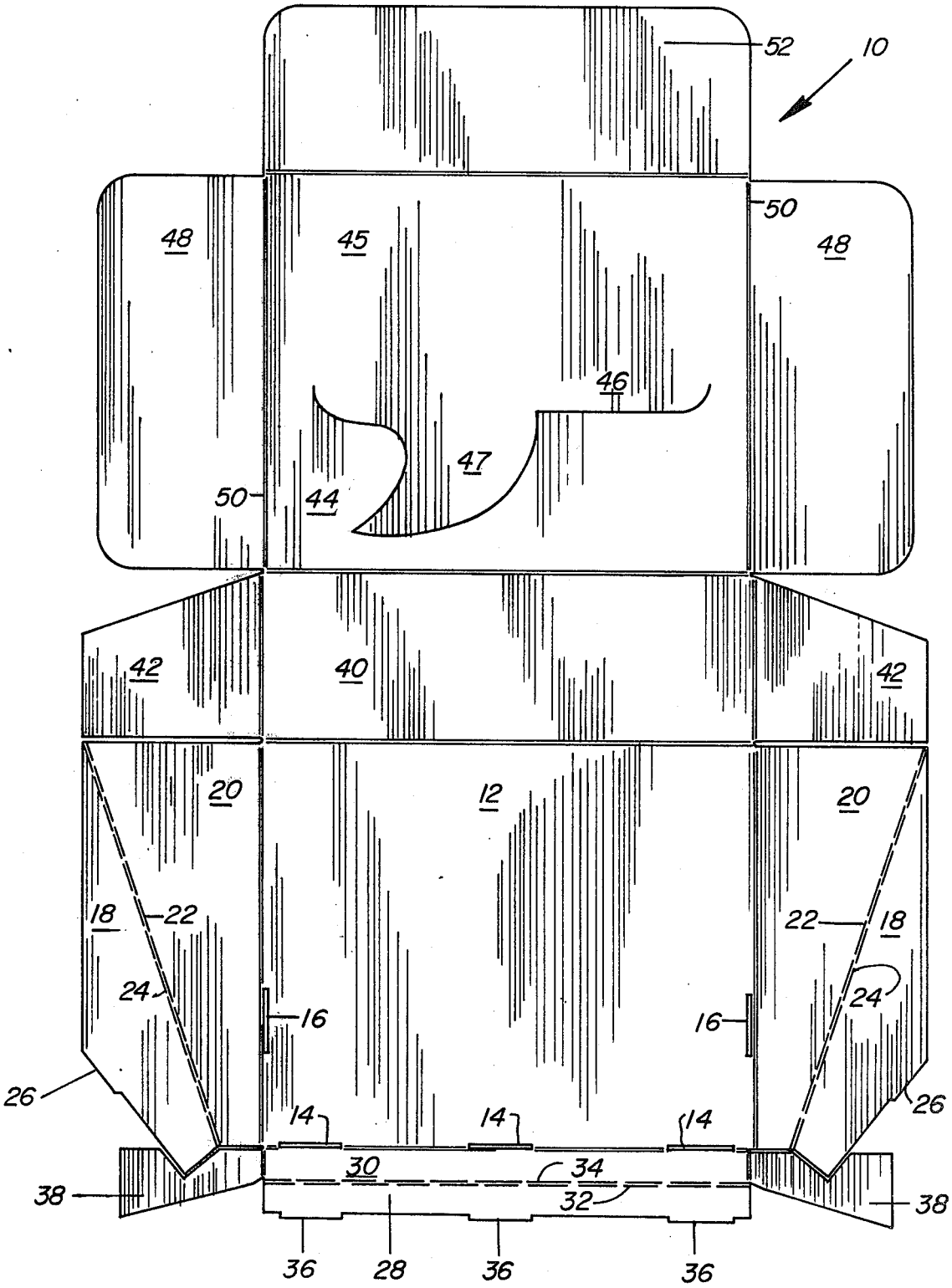
FIG. 1 is a top plan view of the shipping and display container in the present invention, in which the container has been folded out in a flat plane in order to illustrate various portions thereof.

A shipping and display container in accordance with the present invention will be described with reference to FIGS. 1, 2, and 3.

The shipping and display container, referred to generally as 10, includes a bottom wall 12 having a number of locking holes 14, for example two locking holes along a forward edge of the bottom wall. Additionally, the bottom wall includes two locking holes 16, each along opposing side edges of the bottom wall 12.

The container 10 further includes a pair of side walls joined along the opposing edges of the bottom wall 12. Each side wall is formed of two separate portions 18, 20, separated by a pair of perforated folding lines, 22, 24. As shown in FIG. 1, the folding lines 22, 24, start at an outside corner of the side wall and extend inward toward the front of the bottom wall 12. Each side wall portion 18 further includes a locking tab 26 which is adapted to extend into the locking hole 16 in a manner hereinafter described.

The container 10 further includes a front wall formed as two front wall portions 28, 30 which are divided by a pair of perforated folding lines, 32, 34, the folding lines extending substantially parallel to the forward edge of the bottom wall 12. The outermost front wall portion 28 includes three locking tabs 36 which are adapted to extend into the locking holes 14 of the bottom wall 12, again as hereinafter described. The front wall portion 28 further includes a pair of supporting flaps 38 extending from opposite sides thereof. As shown on FIGS. 1 and 2, these supporting flaps are substantially triangular in shape.

The container 10 further includes a back wall 40 joined to the bottom wall 12 along an edge substantially parallel to the edge of the bottom wall to which the front wall 28, 30 is joined. The back wall has a lengthwise dimension L which is substantially greater than the corresponding dimension of both of the front wall portions 28, 30. The back wall 40 includes supporting flaps 42 which extend from opposite sides thereof and having a substantially triangular shape, the supporting flap being shown in FIG. 2 folded parallel with the side wall portion 20.

Figure 2:
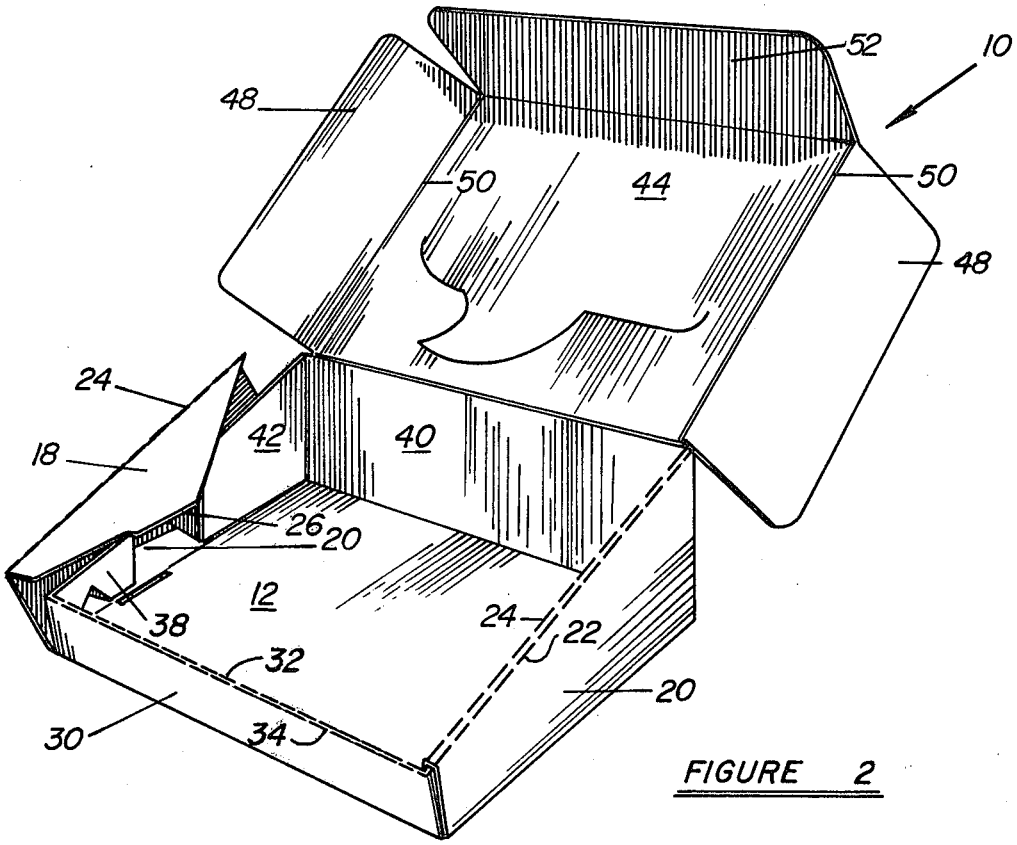
FIG. 2 is a front, prospective view illustrating the shipping and display container in the present invention shown in the shipping position, but with one side wall opened to illustrate the construction of each side of the container.
Figure 3:
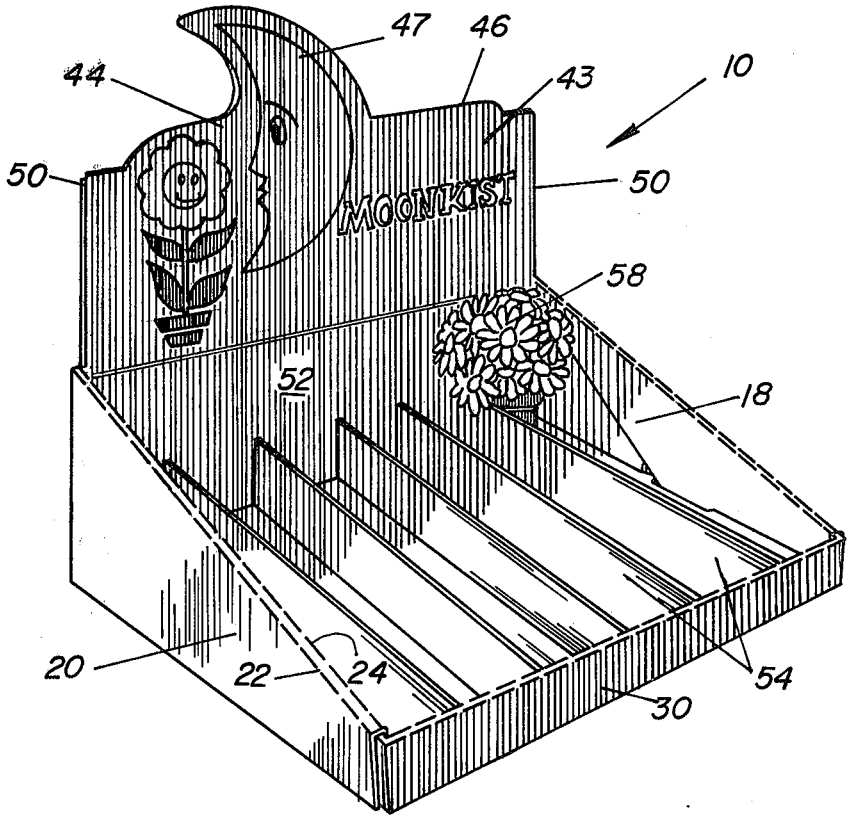
FIG. 3 is a prospective view similar to that of FIG. 1, illustrating the shipping and display carton of the present invention in a display position.

The container 10 includes a top wall 44 having an inner face 45 in a direction towards the bottom wall 12 when the container 10 is in the shipping position (note FIG. 2), and an outer face 43 which extends across the void defined by the container 10 when the container is folded into the display position (note FIG. 3). A printed message or similar advertising is suitably contained on the outer face 43.

The top wall 44 includes a weakened line 46 extending across the top wall substantially parallel with the edge to which the top wall is going to the back wall 40. This weakened line may include a cut out portion 47 which forms a part of the advertising.

The top wall 44 further includes a pair of side flaps 48 which are mounted along opposing edges of the top wall 44 with a perforated tear line 50 between each flap and the main body of the top wall 44. Additionally, the top wall 44 includes a forward flap 52 having a lengthwise dimension which is substantially the same as the lengthwise dimension L at the back wall 40. As is shown in FIG. 2, the side flaps 48 are adapted to fold downward and extend inside the void defined by the bottom wall 12; the side wall 18, 20, the front wall 28, 30; and the top wall 44 such that each side flap 48 is substantially parallel with the corresponding side wall portion 18, 20 and in abutment with the side wall portion 18. This allows each side flap 48 to protect the contents of the container during shipping.

In a like manner, the forward flap 52 of the top wall 44 extends downward and in abutment with the inner portion 28 of the front wall 28, 30 so as to protect the contents of the container 10 during shipping.

Reference is now specifically made to FIG. 2. As shown on the left side of FIG. 2, each side wall consists of the outer portion 20 and the inner portion 18 which is folded along the fold lines 22, 24 such that the inner portion 18 is substantially parallel with the outer portion 20, with a slight space therebetween. The tab 26 is locked into the hole 16, with the supporting flap 38 of the front wall 28, 30 and the supporting flap 42 of the back wall extending between the respective side wall portions 18, 20 in order to provide rigid support.

In a similar manner, the front wall 28, 30 is folded along the fold line 32, 34 allowing the inner portion 28 to extend substantially parallel with the outer portion 30. Thereafter, the locking tabs 36 are extended into the hole 14.

Reference is now made to FIG. 3. As there shown, the container 10 may be folded into the display position by folding the top wall 44 along the weakened line 46. Thereafter, the forward flap 52 is extended substantially parallel and in abutment with the back wall 40. The side flaps 48 of the top wall 44 are removed by tearing these flaps along the perforated lines 50. The forward flap 52 is anchored in place in abutment with the back wall 40 by rigid dividers 54 which extend substantially parallel with the side walls 18, 20. Additionally, container trays 56 may be installed between the dividers 54, and the plants or similar articles to be shipped and thereafter displayed may be inserted with the tray 56.

It will be understood by those skilled in the art that the provision of the back wall 40 and the forward flap 52 having a substantially similar lengthwise dimension L facilitates the installation of the flap 52 in a manner which permits the display of the printed material contained on the outer face 43 of the top wall 44.

I claim:

1. A shipping and display carton comprising:

a bottom wall;

a back wall joined to said bottom wall and substantially normal thereto;

opposing first and second side walls, each joined substantially normal to said bottom and back walls;

a top wall joined along one edge thereof to said back wall, said top wall having an inner face toward said bottom wall when said top wall is parallel thereto, and an outer face with a printed message thereon opposing said inner face, said top wall having first and second flaps along opposing edges thereof, which opposing edges are normal to said one edge of said top wall, said side flaps extending parallel to and in abutment with the corresponding one of said first and second side walls when said top wall is in a shipping position parallel with said bottom wall;

means permitting bending of the top wall along a line substantially parallel with said one edge thereof, whereby said outer face may be bent into two portions and folded into a display position substantially parallel to said end wall with said message facing outward therefrom;

means within the void designed by said walls for holding said bent top wall in said display position; and means for facilitating removal of said flaps from said top wall, said removal means comprising a perforated tear line along each said opposing edge of said top wall.

2. The container recited in claim 1 wherein said bend permitting means comprises said top wall having a weakened strip parallel with said one edge.

3. The container recited in claim 1 wherein said top wall further includes a front flap along the forward edge of said top wall and between said opposing edges, said front flap being movable to extend substantially normal to the inner face of the top wall when said top wall is in such shipping position and being rotatable to a position in abutment with said back wall when said top wall is in said display position.

4. The container recited in claim 3 wherein said front flap is dimensioned substantially identical to said back wall.

5. The container recited in claim 4 wherein said two portions of said outer face each have dimensions substantially identical to that of said front flap and said back wall.

6. The container recited in claim 1 wherein said container further includes a front wall along an edge of said bottom wall between said two side walls and substantially parallel with said back wall, said walls dimensioned such that said front flap is in abutment with said front wall when said top wall is in said shipping position.

7. The container recited in claim 6 wherein said folding means comprises a divider extending between said front and back walls, said front flap adapted to extend between the extremities of said divider and said back wall when said top wall is in said display position.

8. The container recited in claim 6 wherein said back wall is substantially longer than said front wall in the respective dimensions between said top and bottom walls, and wherein said side walls slope from the respective corner of said one edge of said top wall to the extremity of said front wall.

9. The container recited in claim 8 wherein each side wall is formed of inner and outer portions, said inner portions folded parallel with said outer portions and having a locking tab extending through said bottom wall.

10. The container recited in claim 9 wherein said back wall includes two supporting flaps on opposite sides thereof, each supporting flap extending parallel with the corresponding side wall and between the inner and outer portions thereof.

11. The container recited in claim 9 wherein said front wall is formed of inner and outer portions, said inner portions folded parallel with said outer portion and having a locking tab extending through said bottom wall.

12. The container recited in claim 11 wherein said front wall includes two supporting flaps on opposite sides thereof, each supporting flap extending parallel with the corresponding side wall between the inner and outer portions thereof.

13. A shipping and display carton comprising:

a bottom wall;

a back wall joined to said bottom wall and substantially normal thereto;

opposing first and second side walls each joined substantially normal to said bottom and back wall;

a top wall joined along one edge thereof to said back wall, said top wall having an inner face toward said bottom wall when said top wall is parallel thereto, and an outer face with a printed message thereon opposing said inner face, said top wall having first and second flaps along opposing edges thereof, which opposing edges are normal to said one edge of said top wall, said side flaps extending parallel to and in abutment with the corresponding one of said first and second side walls when said top wall is in a shipping position parallel with said bottom wall;

means for facilitating removal of said flaps from said top wall, said removal means comprising a perforated tear line along each said opposing edge of said top wall;

means permitting bending of the top wall along a line substantially parallel with said one edge thereof, whereby said outer face may be bent into two portions and folded into a display position substantially parallel to said end wall with said message facing outward therefrom; and a front wall between said two side walls substantially parallel with said back wall, said wall dimensioned such that said front flap is in abutment with said front wall when said top wall is in said supporting position, said front wall being formed of inner and outer portions with the inner portions folded parallel with the outer portion and having a locking tab extending through said bottom wall.

14. The container recited in claim 13 wherein each side wall is formed of inner and outer portions, said inner side wall portion folded parallel with said outer side wall portion and having a locking tab extending through said bottom wall.

15. The container recited in claim 14 wherein said back wall includes two supporting flaps on opposite sides thereof, each supporting flap extending parallel with the corresponding side wall and between the inner and outer portions thereof.

* * * * *